US010202788B2

(12) United States Patent
Inai et al.

(10) Patent No.: US 10,202,788 B2
(45) Date of Patent: Feb. 12, 2019

(54) DOOR OUTER HANDLE

(71) Applicant: HONDA MOTOR CO., LTD., Tokyo (JP)

(72) Inventors: Yohei Inai, Wako (JP); Jun Nakamura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 185 days.

(21) Appl. No.: 14/474,647

(22) Filed: Sep. 2, 2014

(65) Prior Publication Data

US 2015/0061305 A1 Mar. 5, 2015

(30) Foreign Application Priority Data

Sep. 2, 2013 (JP) ..... 2013-181234

(51) Int. Cl.
*E05B 3/00* (2006.01)
*E05B 85/16* (2014.01)
(Continued)

(52) U.S. Cl.
CPC ..... *E05B 85/16* (2013.01); *E05B 77/06* (2013.01); *E05B 77/24* (2013.01); *E05B 77/245* (2013.01); *Y10T 292/57* (2015.04)

(58) Field of Classification Search
CPC ..... E05B 85/16; E05B 85/10; E05B 85/14; E05B 77/06; E05B 77/24; E05B 77/245
(Continued)

(56) References Cited

U.S. PATENT DOCUMENTS 3,719,248 A * 3/1973 Breitschwerdt ..... E05B 77/06 180/271
5,669,642 A * 9/1997 Kang ..... E05B 77/06 292/336.3
(Continued)

FOREIGN PATENT DOCUMENTS

CN 2401394 Y 10/2000
JP 2006-77568 A 3/2006

OTHER PUBLICATIONS

Office Action dated Jan. 21, 2016, issued in counterpart Chinese Patent Application No. 201410440292.0. (6 pages).
(Continued)

*Primary Examiner* — Kristina R Fulton
*Assistant Examiner* — Faria F Ahmad
(74) *Attorney, Agent, or Firm* — Westerman, Hattori, Daniels & Adrian, LLP

(57) ABSTRACT

A door outer handle which can be easily attached to an outer panel from the outside and in which the size of a counter weight is sufficiently ensured is provided. A door outer handle has an elongated shape. A hinge portion provided at one end of the door outer handle is inserted into a first attachment hole, and a counter weight provided at the other end of the door outer handle is inserted into a second attachment hole. An outer circumferential surface of the counter weight, which is located farthest from a contact point, is formed in an arc shape with a first radius, centered at the contact point. Furthermore, an inner circumferential surface of the counter weight, which is located closer to the contact point than the outer circumferential surface, is also formed in an arc shape with a second radius, centered at the contact point.

8 Claims, 9 Drawing Sheets

(51) Int. Cl.
*E05B 77/06* (2014.01)
*E05B 77/24* (2014.01)

(58) Field of Classification Search
USPC ..... 292/336.3, DIG. 22
See application file for complete search history.

(56) References Cited

U.S. PATENT DOCUMENTS 6,007,122 A * 12/1999 Linder ..... E05B 85/10 292/216
6,709,033 B2 * 3/2004 Jooss ..... E05B 77/06 16/412
7,070,216 B2 * 7/2006 von zur Muehlen ... E05B 77/06 292/336.3
8,038,185 B2 * 10/2011 Wood ..... E05B 77/06 292/336.3
8,814,232 B2 * 8/2014 Bertolotti ..... E05B 77/06 292/336.3
9,810,006 B2 * 11/2017 Papanikolaou ..... E05B 85/14
2003/0001399 A1 1/2003 Sato
2005/0161959 A1 * 7/2005 Belchine, III ..... E05B 77/06 292/336.3
2006/0038418 A1 * 2/2006 Huizenga ..... E05B 77/06 292/336.3
2006/0049647 A1 3/2006 von zur Muehlen
2007/0080547 A1 * 4/2007 Lee ..... E05B 77/06 292/336.3
2008/0277948 A1 * 11/2008 Takaya ..... E05B 85/16 292/336.3
2009/0102206 A1 * 4/2009 Lee ..... E05B 77/06 292/336.3
2013/0056999 A1 * 3/2013 Beck ..... E05B 77/06 292/336.3
2013/0187394 A1 * 7/2013 Lesueur ..... E05B 77/06 292/336.3
2013/0221690 A1 * 8/2013 Rocci ..... E05B 77/06 292/336.3
2013/0234455 A1 * 9/2013 Rocci ..... E05B 77/06 292/336.3
2014/0312633 A1 * 10/2014 Ilardo ..... E05B 77/06 292/336.3
2015/0042111 A1 * 2/2015 Ichikawa ..... E05B 77/06 292/336.3
2015/0061304 A1 * 3/2015 Ichikawa ..... E05B 85/16 292/336.3
2015/0167362 A1 * 6/2015 Kang ..... E05B 85/16 292/336.3
2015/0322699 A1 * 11/2015 Ilardo ..... E05B 77/06 292/336.3
2016/0069104 A1 * 3/2016 Ilardo ..... E05B 77/06 292/336.3

OTHER PUBLICATIONS

Office Action dated Sep. 12. 2016, issued in counterpart Chinese Patent Application No. 201410440292.0, with English translation. (13 pages).

* cited by examiner

COMPARATIVE EXAMPLE

EMBODIMENT

DOOR OUTER HANDLE

CROSS REFERENCES TO RELATED APPLICATIONS

The present application claims priority under 35 U.S.C. § 119 to Japanese Patent Application No. 2013-181234, filed Sep. 2, 2013, entitled "Door Outer Handle." The contents of this application are incorporated herein by reference in their entirety.

TECHNICAL FIELD

The present disclosure relates to an improvement of a door outer handle provided on a vehicle door.

BACKGROUND

Some doors of vehicles, such as cars, are opened by pulling a door outer handle. When the door outer handle is pulled, a latch unit is operated via a rod, releasing the latch unit. The door is required to remain closed even when the vehicle experiences a side collision, and the door is deformed. A door outer handle that has a structure for preventing unlatching to keep the door closed in such a situation is known (for example, see Japanese Unexamined Patent Application Publication No. 2006-77568 (FIG. 1)).

The door outer handle disclosed in Japanese Unexamined Patent Application Publication No. 2006-77568 is formed in a shape elongated in the vehicle's front-rear direction and is provided on a door so as to be rotatable in the door's outside-inside direction about a hinge portion provided at the front end of the door outer handle. A counter weight is provided at the rear end of the door outer handle in a rotatable manner. When the door outer handle is pulled, the counter weight is pushed via a spring and rotated. The counter weight is engaged with a cam plate, rotating the cam plate and releasing the latch via a cable.

When the vehicle experiences a side collision, the door outer handle moves due to the deformation of the door, and the counter weight is pushed by the spring. However, because the inertial force acts on the counter weight, the counter weight resists the pushing force of the spring and remains in the same position. As a result, the counter weight is not engaged with the cam plate, preventing unlatching. The counter weight is required to have a certain weight to generate a sufficient inertial force. Hence, the counter weight has to be increased in size to have such a weight.

However, if the size of the counter weight is increased in the vehicle's width direction, the space inside the door for the other components is reduced. If the size of the counter weight is increased in the front-rear direction or top-bottom direction, the counter weight would be larger than an attachment hole provided in an outer panel. This makes it difficult to insert the counter weight into the outer panel when the door outer handle is attached to the door, making the attaching operation difficult.

SUMMARY

The present application provides a door outer handle in which a counter weight has a sufficient size and which can be easily attached to an outer panel from the outside.

A first aspect of an embodiment is a door outer handle to be attached to an outer panel of a vehicle door from the outside, the outer panel having a first attachment hole and a second attachment hole arranged side-by-side in a vehicle's front-rear direction. The door outer handle is formed in a shape elongated in the vehicle's front-rear direction. The door outer handle has, at one end in a longitudinal direction, a contact point that comes into contact with an edge of the first attachment hole when attached to the outer panel, the door outer handle being rotatable in a door's outside-inside direction about the contact point. The door outer handle is provided with, at the other end in the longitudinal direction, a counter weight that can be inserted into the door through the second attachment hole. An outer circumferential surface of the counter weight, which is located farthest from the contact point, is formed in an arc shape, formed by a part of a circle having a center at the contact point. Because of this configuration, the outer circumferential surface of the counter weight conforms to the path of a circle centered at the contact point, the path being followed when the door outer handle is rotated in the door's outside-inside direction about the contact point and attached to the outer panel. As a result, the volume of the counter weight on the outer circumferential surface side can be increased, thereby reducing the size thereof in the vehicle's width direction, and it is possible to ensure a sufficient size of the counter weight. Furthermore, because the outer circumferential surface of the counter weight is formed in an arc shape based on the circle centered at the contact point, the counter weight can be inserted into the second attachment hole so as to conform to the path of a circle centered at the contact point, the path being followed when the door outer handle is attached to the outer panel. As a result, the door outer handle can be easily attached to the outer panel from the outside.

The door outer handle according to the first aspect is preferably configured such that an inner circumferential surface of the counter weight, which is located closer to the contact point than the outer circumferential surface, is also formed in an arc shape, formed by a part of a circle having a center at the contact point. Because both the inner and outer circumferential surfaces of the counter weight have shapes conforming to the paths of circles centered at the contact point, the center of gravity of the counter weight can be placed closer to the contact point than to the center of the second attachment hole. More specifically, the counter weight has such a shape that a portion of the outer circumferential surface is removed, and the removed portion is added to the inner circumferential surface. Hence, the center of gravity of the counter weight can be placed even closer to the contact point, at a position near the center of gravity of the door outer handle. This configuration increases the inertial force generated in the counter weight in the event of a side collision of a vehicle, enabling the counter weight to effectively function.

The door outer handle according to the first aspect is more preferably configured such that the counter weight has a snap portion via which a rod used to open or close the door is elastically attached to the counter weight, and such that the entire snap portion is located between the inner circumferential surface and the outer circumferential surface. Because of this configuration, the door outer handle can be attached to the outer panel with the snap portion being attached to the counter weight. Thus, the productivity improves.

BRIEF DESCRIPTION OF THE DRAWINGS

The advantages of the disclosure will become apparent in the following description taken in conjunction with the following drawings.

DETAILED DESCRIPTION

An embodiment will be described below with reference to the attached drawings.

Figure 1:
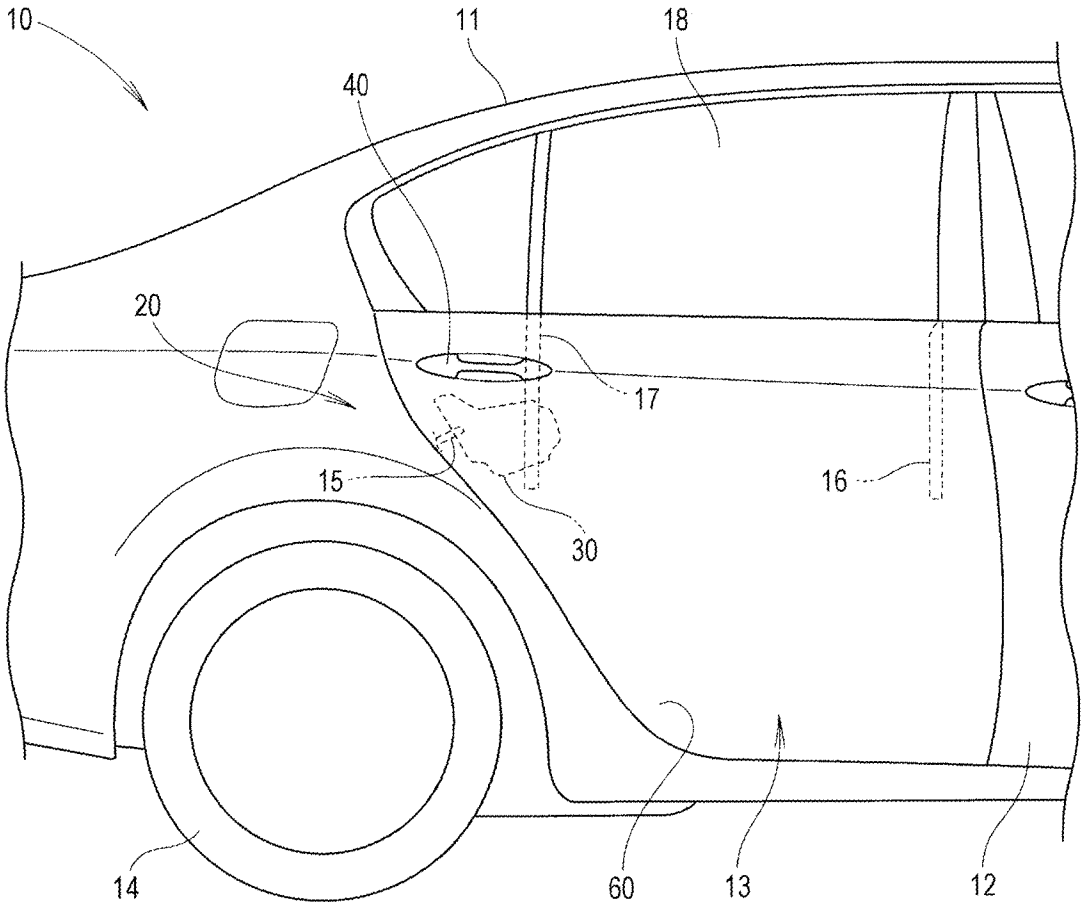
FIG. 1 is a side view of the vicinity of a door outer handle of a vehicle of an embodiment of the present disclosure.

A side portion of a vehicle to which a vehicle-door locking device according to an embodiment is attached will be described. As shown in FIG. 1, a vehicle 10 is a car that includes a vehicle body 11, left and right front doors 12, and left and right rear doors 13, and wheels 14.

Hereinbelow, a vehicle-door locking device 20 attached to the right rear door 13 will be described. The vehicle-door locking device 20 includes a striker 15 provided on the vehicle body 11, a latch unit 30 provided inside the rear end of the door 13, and a door outer handle 40 provided outside the rear part of the door 13.

The latch unit 30 latches or unlatches the striker 15 upon operation of the door outer handle 40. When the striker 15 is latched, the door 13 is closed, and when the striker 15 is unlatched, the door 13 is opened.

A center sash 16 is provided at the front part of the door 13, and a rear sash 17 (hereinbelow, "a door sash 17") is provided at the rear part of the door 13. The center sash 16 and the door sash 17 support a pane of glass 18 in such a manner that it can be moved up and down. The door sash 17 extends upward from the vicinity of the latch unit 30 inside the door 13.

Figure 2:
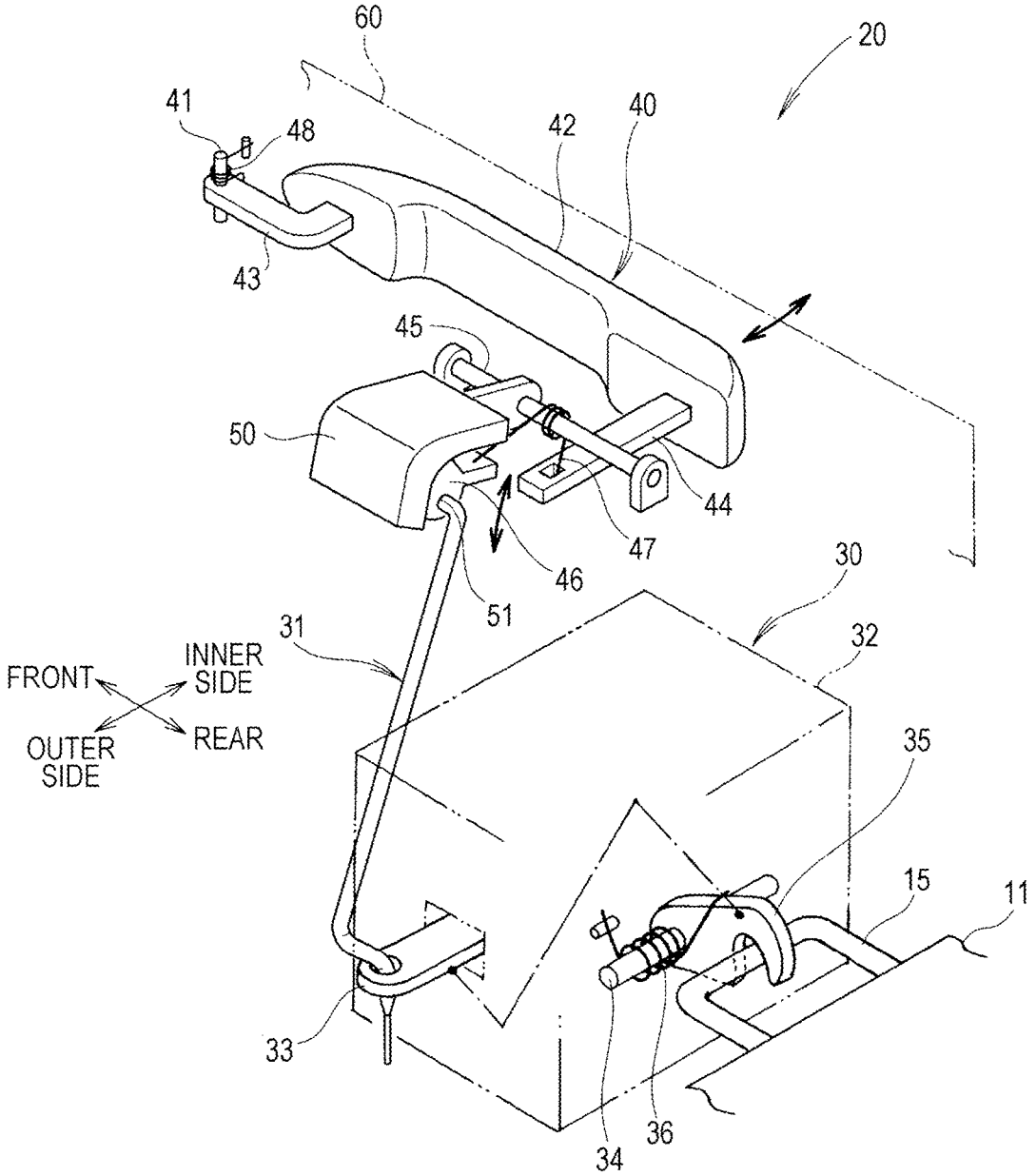
FIG. 2 is a conceptual diagram for explaining the basic principle of a vehicle-door locking device shown in FIG. 1.

Next, the basic principle of the vehicle-door locking device will be described. As shown in FIG. 2, the vehicle-door locking device 20 includes the door outer handle 40 provided on an outer panel 60 of the door 13 (see FIG. 1) so as to be able to pivot about a handle shaft 41, a rod 31 that is moved up and down by the door outer handle 40, and the latch unit 30 that unlocks the door when pushed down by the rod 31.

The door outer handle 40 includes a handle body 42 elongated in the vehicle's front-rear direction, a hinge portion 43 having a substantially L shape in plan view and provided at an end of the handle body 42 in the longitudinal direction, an engagement piece 44 provided at the other end of the handle body 42 in the longitudinal direction and extending toward the inner side in the vehicle's width direction, a rotation member 46 capable of swinging about the support shaft 45, a counter weight 50 provided integrally with the rotation member 46, and a torsion spring 47 provided on the support shaft 45 in a rotatable manner and engaged with the engagement piece 44 at one end.

The handle body 42 is provided on the handle shaft 41 via the hinge portion 43 so as to be able to swing and is urged toward the inner side in the vehicle's width direction by a hinge-portion elastic member 48. When the handle body 42 is pulled toward the outer side in the vehicle's width direction, the engagement piece 44 moves outward in the vehicle's width direction, rotating the torsion spring 47 and bringing the other end of the torsion spring 47 into contact with the rotation member 46. The torsion spring 47 urges the rotation member 46 and the counter weight 50 in a direction in which they are rotated downward. The upper end of the rod 31 is coupled to a support hole 51 in the counter weight 50. When the counter weight 50 is rotated downward, the rod 31 is pushed downward.

The latch unit 30 includes a latch unit body 32, an unlatching lever 33 provided on the latch unit body 32 so as to be able to swing up and down and coupled to the lower end of the rod 31, and a latch 35 provided on a latch shaft 34 of the latch unit body 32 so as to be able to swing and engaged with the striker 15. The latch 35 is urged in a direction in which the latch 35 is engaged with the striker 15 by a latch-elastic member 36. When the unlatching lever 33 is pushed downward, the latch 35 is disengaged.

More specifically, when the handle body 42 is pulled outward in the vehicle's width direction, the rod 31 pushes the unlatching lever 33 in an unlatching direction. As a result, the unlatching lever 33 is displaced, releasing the latch 35 from the striker 15 and unlatching the door 13 (see FIG. 1). Thereafter, the rod 31 is pulled back, returning to the original position.

Figure 3:
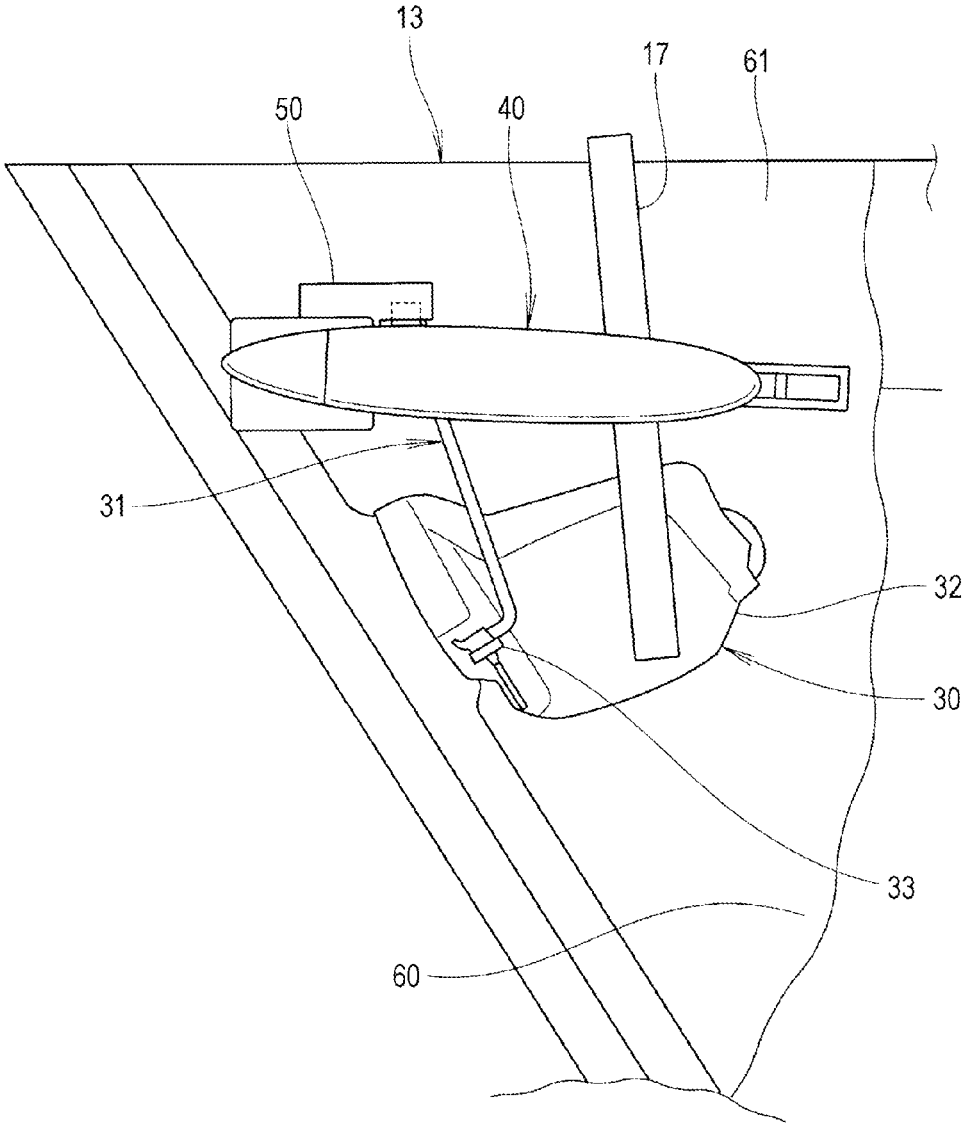
FIG. 3 is an enlarged view of the relevant part in FIG. 1.

Next, the attaching position of the latch unit will be described. As shown in FIG. 3, the door 13 is formed of the outer panel 60 and an inner panel 61. The door outer handle 40 is provided at the rear part of the outer panel 60, and the latch unit 30 is provided at the rear part of the inner panel 61, below the door outer handle 40. The door outer handle 40 is located above the latch unit 30.

The rod 31, which is connected to the rear part of the door outer handle 40 via the counter weight 50, extends downward. The lower end of the rod 31 is connected to the unlatching lever 33.

The door sash 17 is disposed on the inner side (i.e., far side in FIG. 3) than the door outer handle 40 and the rod 31 in the vehicle's width direction, and on the outer side (i.e., near side in FIG. 3) than the latch unit body 32 in the vehicle's width direction. In short, the door sash 17 is disposed between the rod 31 and the latch unit 30.

Figure 4:
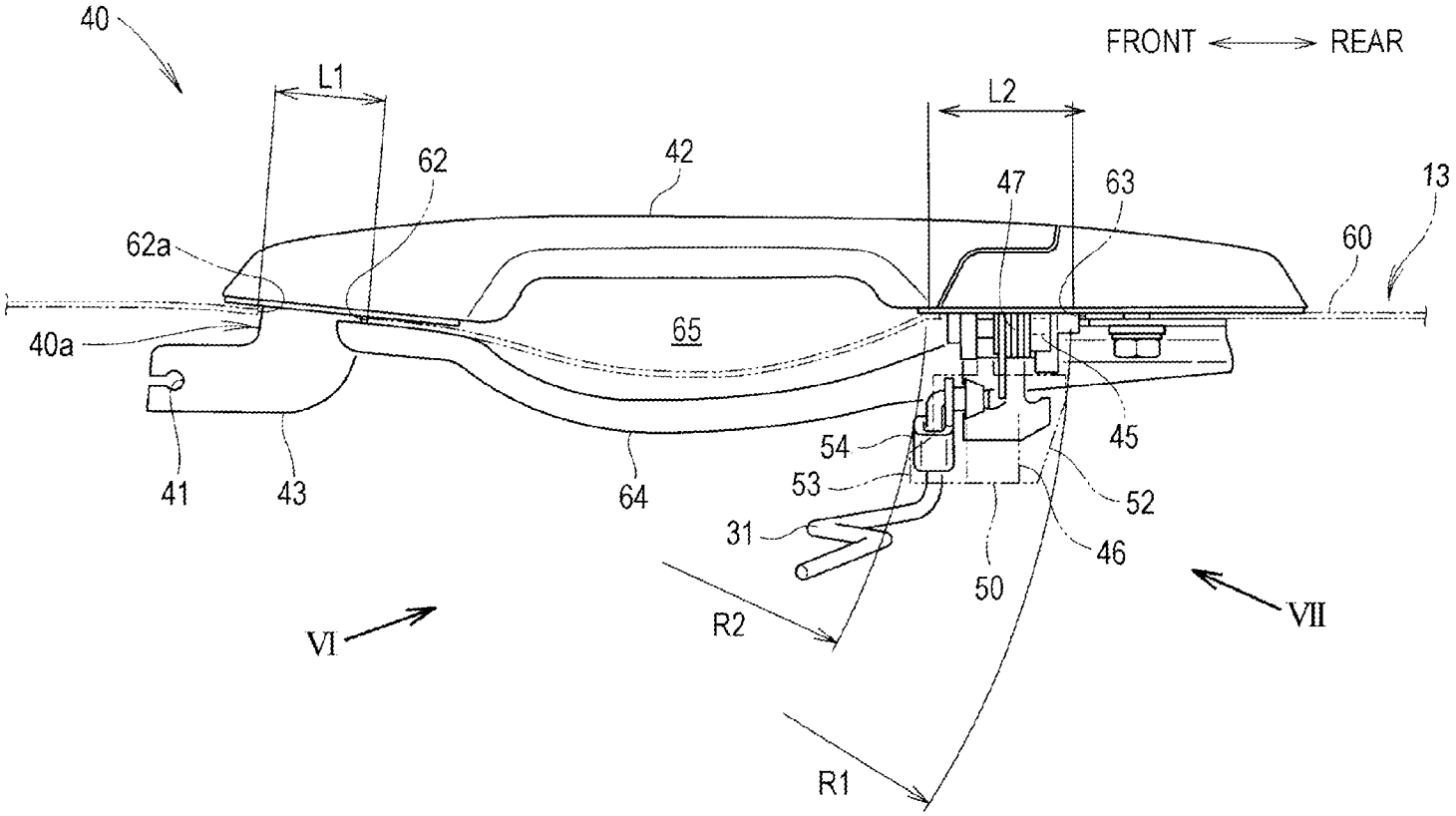
FIG. 4 is a plan view of a door outer handle of the present disclosure.

Next, a state in which the door outer handle is attached to the outer panel will be described with reference to a plan view. As shown in FIG. 4, a first attachment hole 62 and a second attachment hole 63, which are side-by-side in the vehicle's front-rear direction, are provided in the outer panel 60.

The door outer handle 40 is formed in an elongated shape extending in the vehicle's front-rear direction. The hinge portion 43 provided at one end of the door outer handle 40 in the longitudinal direction is inserted into the first attachment hole 62. The counter weight 50 provided at the other end of the door outer handle 40 in the longitudinal direction is inserted into the second attachment hole 63.

The hinge portion 43 and the counter weight 50 are provided on the handle body 42, and the door outer handle 40 is attached to the outer panel 60 from the outside. A reinforcing member 64 is provided inside the outer panel 60. One end of the reinforcing member 64 is fastened to one end of the door outer handle 40 with the outer panel 60 therebetween, and the other end of the reinforcing member 64 is fastened to the other end of the door outer handle 40 with the outer panel 60 therebetween.

A grip space 65, into which a hand is inserted, is provided between an intermediate portion of the door outer handle 40 and the outer panel 60. Because the grip space 65 is required to be large enough for a hand to enter, the sizes of the first attachment hole 62 and second attachment hole 63 are limited.

The hinge portion 43 has a contact point 40*a* that comes into contact with an edge 62*a* of the first attachment hole 62 when the door outer handle 40 is attached to the outer panel 60. The door outer handle 40 is rotatable in the door's outside-inside direction about the contact point 40*a*.

The counter weight 50 can be inserted into the door through the second attachment hole 63. An outer circumferential surface 52 of the counter weight 50, which is located farthest from the contact point 40*a*, is formed in an arc shape with a radius R1 centered at the contact point 40*a*. Furthermore, an inner circumferential surface 53 of the counter weight 50, which is located closer to the contact point 40*a* than the outer circumferential surface 52, also has an arc-shaped portion with a radius R2 centered at the contact point 40*a*.

The width of the first attachment hole 62 is L1, and the width of the second attachment hole 63 is L2. The relationship between the width L2 of the second attachment hole and the difference between the radius R1 and the radius R2 is (R1−R2)<L2. Although, in the embodiment, the inner circumferential surface 53 has such a shape that the front side of the counter weight 50 is partially swelled, the shape is not limited thereto, and it is also possible that the entire front side of the counter weight 50 serves as the inner circumferential surface 53 with the radius R2.

Furthermore, the counter weight 50 has a snap portion 54 via which the rod 31 is elastically attached to the counter weight 50. The entire snap portion 54 is located between the outer circumferential surface 52 with the radius R1 and the inner circumferential surface 53 with the radius R2. Therefore, the snap portion 54 does not interfere with anything when the counter weight 50 is inserted into the second attachment hole 63. Hence, the size of the counter weight 50 can be increased to the maximum within the difference between the radius R1 of the outer circumferential surface 52 and the radius R2 of the inner circumferential surface 53.

Figure 5:
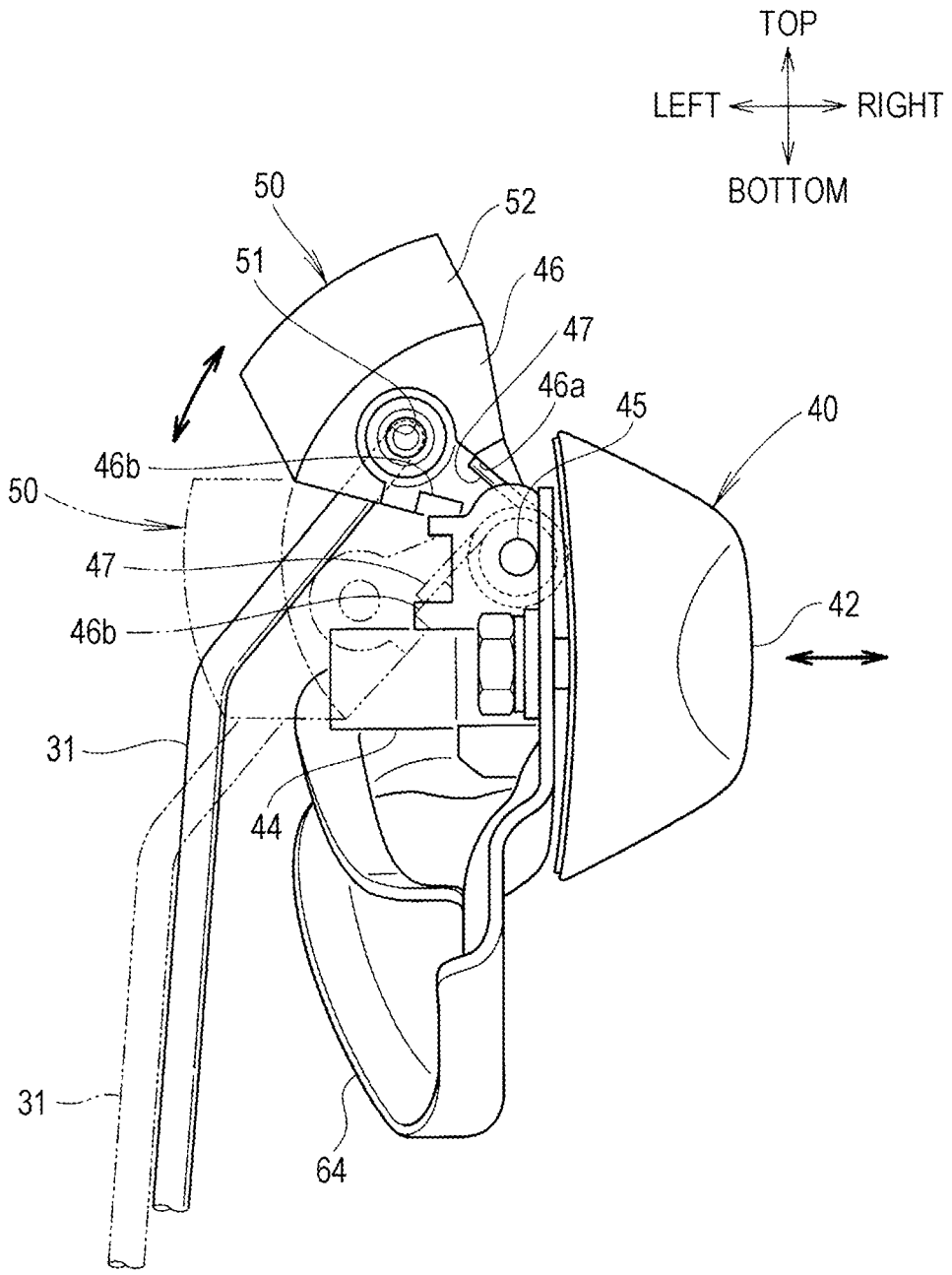
FIG. 5 is a side view of the door outer handle shown in FIG. 4.
Figure 6:
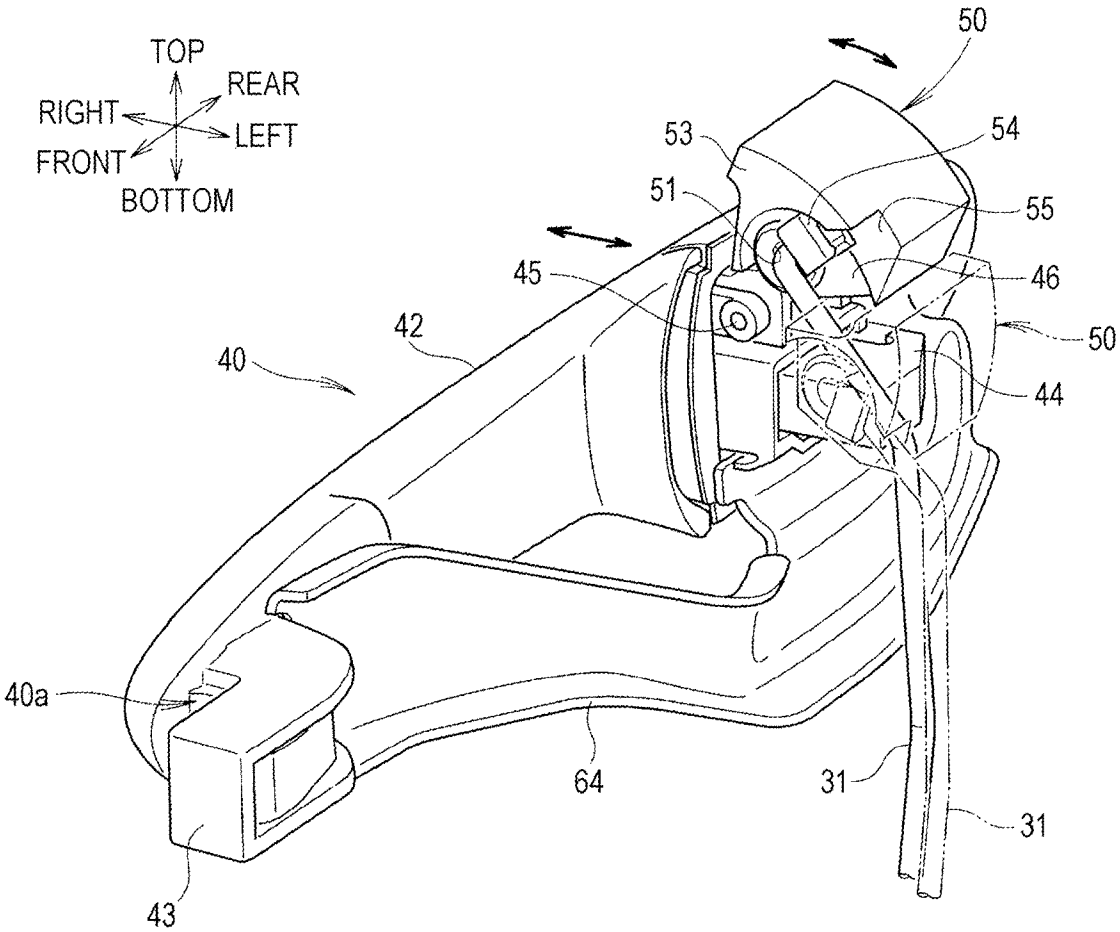
FIG. 6 is a diagram as viewed from the direction indicated by an arrow VI in FIG. 4.
Figure 7:
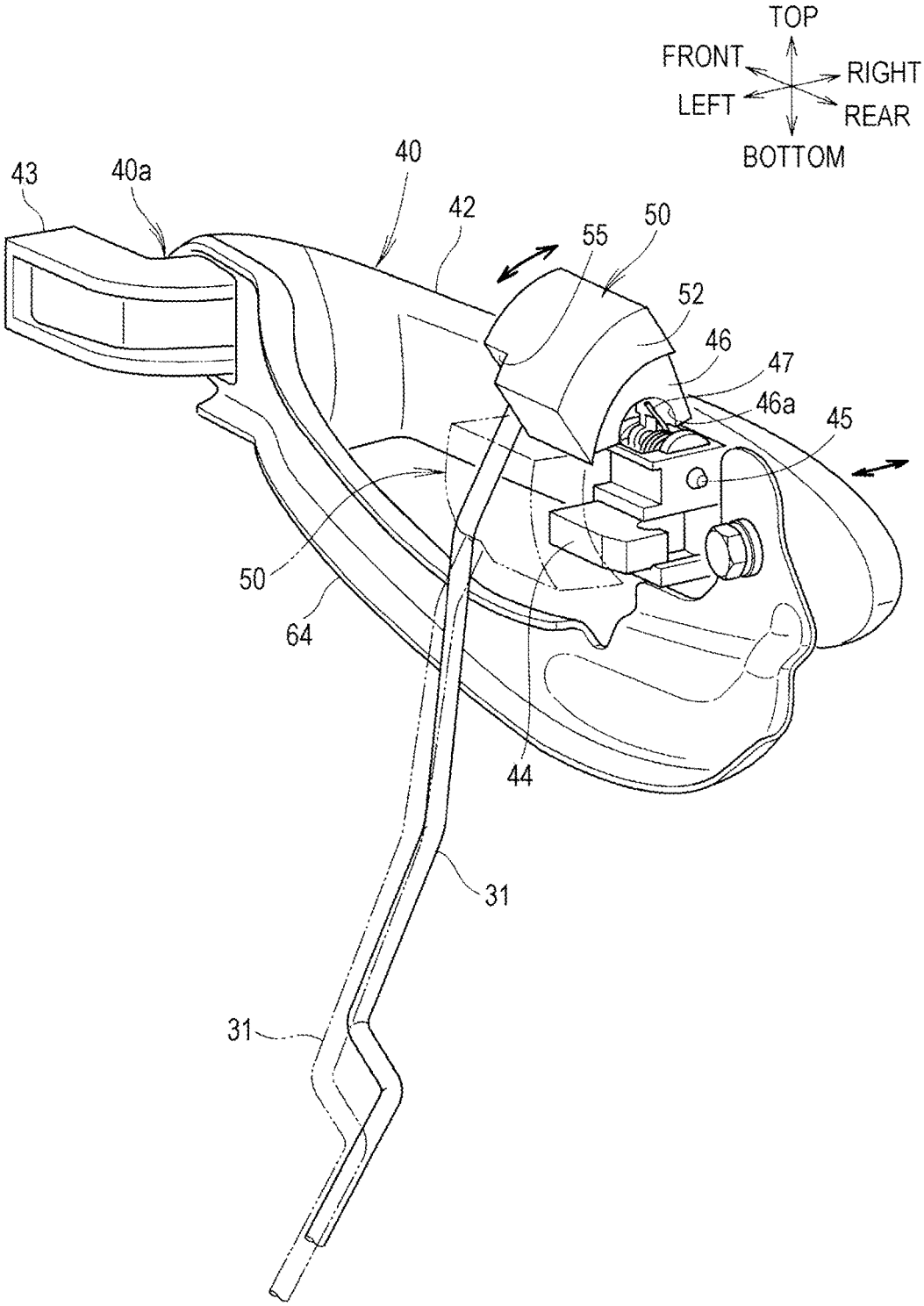
FIG. 7 is a diagram as viewed from the direction indicated by an arrow VII in FIG. 4.

As shown in FIGS. 5 to 7, in a state in which the handle body 42 is not pulled, the counter weight 50 is located at a position above the handle body 42, illustrated with a solid line. An inner side wall 46*a* of the rotation member 46 is urged upward by the torsion spring 47. Furthermore, the rotation member 46 has a receiving portion 46*b* that receives the torsion spring 47 when the torsion spring 47 is rotated downward.

In a state in which the handle body 42 is pulled, the counter weight 50 is located at a position to the left of the handle body 42 in the vehicle's width direction, illustrated with an imaginary line. When the handle body 42 is pulled, the torsion spring 47 is rotated downward and comes into contact with the receiving portion 46*b*, rotating the rotation member 46 and the counter weight 50 downward.

When the vehicle 10 (see FIG. 1) experiences a side collision, the handle body 42 moves, rotating the torsion spring 47 downward. However, the counter weight 50 located above the rotate shaft 45 remains in the same position due to the inertial force. Because the inertial force of the counter weight 50 is greater than a force urging the rotation member 46 downward, which is exerted by the torsion spring 47 rotating downward, the rotation member 46 is not pushed downward. Hence, the latch 35 (see FIG. 2) is not released, and the door is kept locked.

Furthermore, the rod 31 is anchored to the counter weight 50 by the snap portion 54 of the counter weight 50. The counter weight 50 has a cut-out portion 55. Hence, when the counter weight 50 is rotated downward, the rod 31 is positioned in the cut-out portion 55 and does not inhibit the rotation of the counter weight 50.

Figure 8:
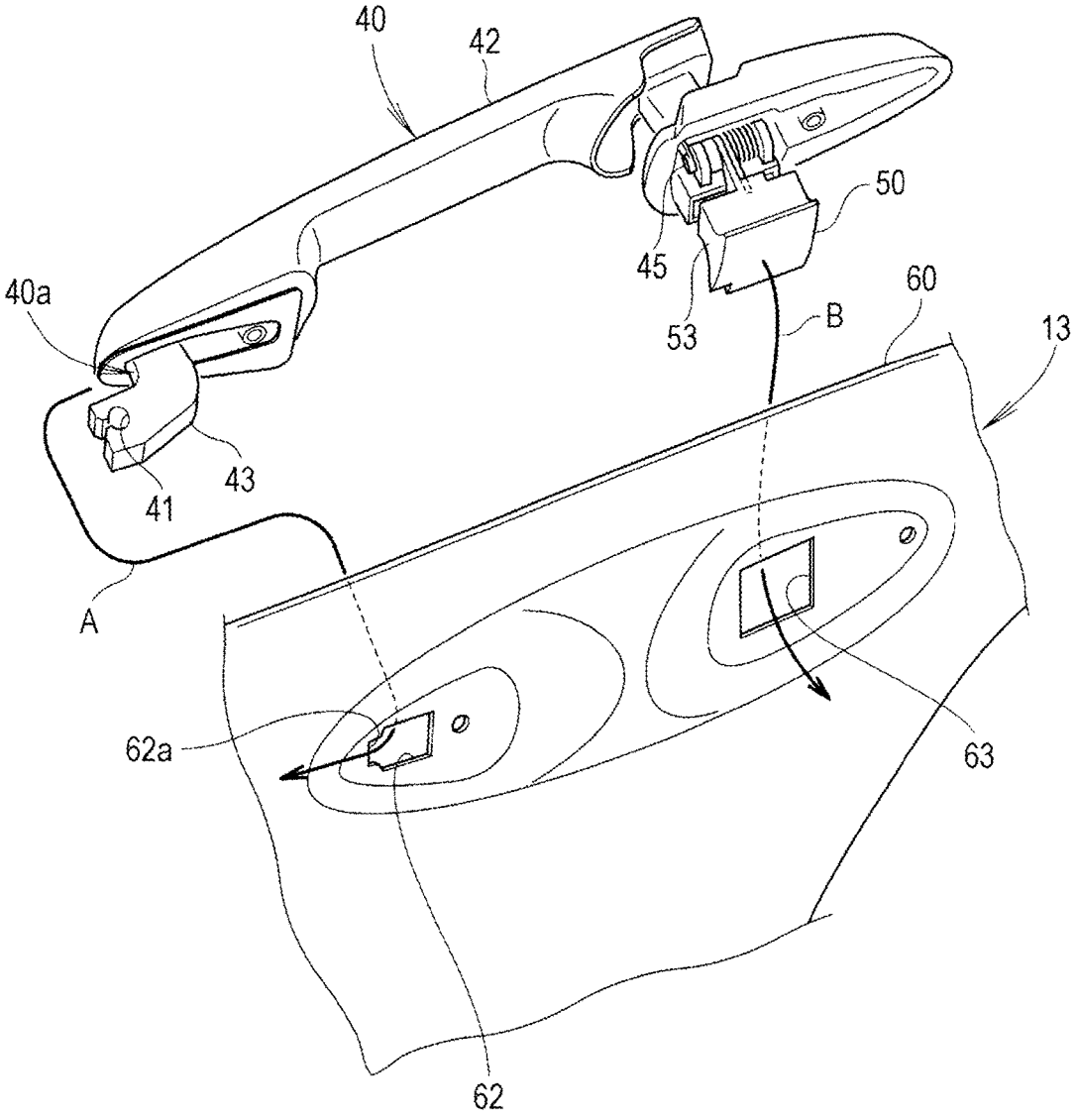
FIG. 8 is a diagram showing the assembly of the door outer handle shown in FIG. 4.

Advantages of the above-described door outer handle will be described below. As shown in FIG. 8, the hinge portion 43 of the door outer handle 40 is inserted into the first attachment hole 62 from the outside of the outer panel 60, as indicated by an arrow A. Then, the counter weight 50 is rotated downward with the handle body 42 being pulled. In this state, with the contact point 40*a* of the hinge portion 43 being in contact with the edge 62*a* of the first attachment hole 62, the door outer handle 40 is rotated about the contact point 40*a*.

The counter weight 50 is inserted into the second attachment hole 63, as indicated by an arrow B, and the door outer handle 40 is fixed to the outer panel 60 with a fastening member (not shown). Because the size of the counter weight 50 is increased so as to conform to the path along which the door outer handle 40 is attached, even a door outer handle in which the handle body 42 and the counter weight 50 are integrated can be easily attached.

Figure 9A:
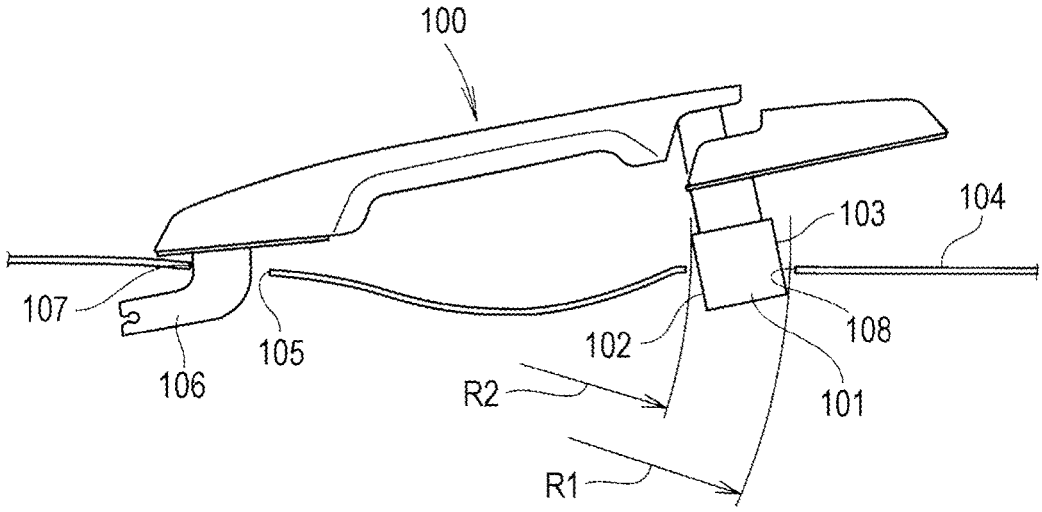
FIGS. 9A and 9B are diagrams showing the operation of the door outer handle shown in FIG. 4.

FIG. 9A is a plan view of a door outer handle 100 according to a comparative example. A counter weight 101 is provided so as to extend in a direction perpendicular to the longitudinal direction of the door outer handle 100. An inner circumferential surface 102 and an outer circumferential surface 103 of the counter weight 101 are flat.

The door outer handle 100 is attached to an outer panel 104 by inserting a hinge portion 106 into a first attachment hole 105 in the outer panel 104 and moving the counter weight 101 into a second attachment hole 108, about a contact point 107. The path of a portion of the outer circumferential surface 103 located farthest from the contact point 107 is formed in an arc shape with a radius R1. Furthermore, the path of a portion of the inner circumferential surface 102 located closest to the contact point 107 is formed in an arc shape with a radius R2.

Figure 9B:
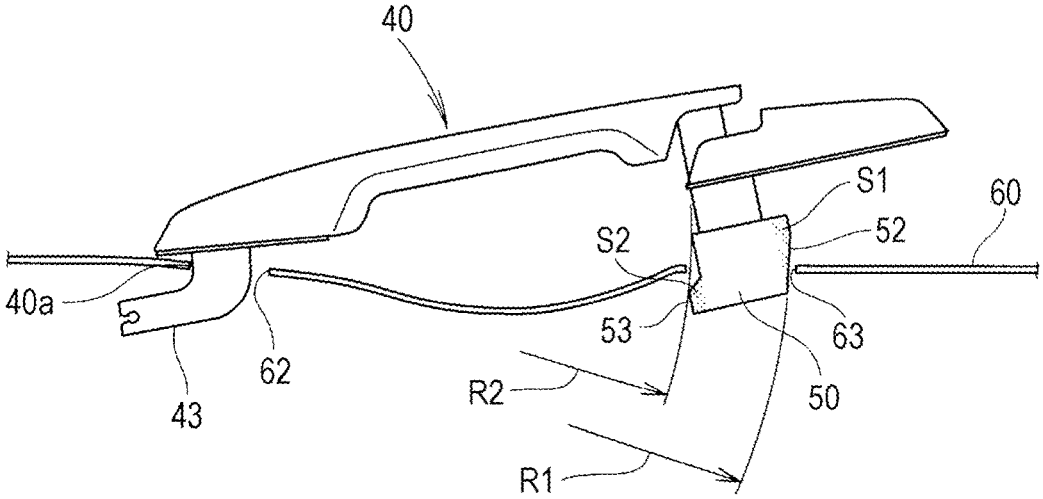

FIG. 9B is a plan view of the door outer handle 40 according to the embodiment. The door outer handle 40 is attached to the outer panel 60 by inserting the hinge portion 43 into the first attachment hole 62 in the outer panel 60 and moving the counter weight 50 into the second attachment hole 63, about the contact point 40*a*. The path of a portion of the outer circumferential surface 52 located farthest from the contact point 40*a* is an arc shape with a radius R1. Furthermore, the path of a portion of the inner circumferential surface 53 located closest to the contact point 40*a* is an arc shape with a radius R2.

In the embodiment, the outer circumferential surface 52 is formed in an arc shape centered at the contact point 40*a*. Therefore, a portion in an area S1 of the counter weight 50 according to the embodiment is larger than that of the counter weight 101 according to the comparative example. Furthermore, in the embodiment, the inner circumferential surface 53 is formed in an arc shape centered at the contact point 40*a*. Therefore, a portion in an area S2 of the counter weight 50 according to the embodiment is larger than that of the counter weight 101 according to the comparative example. As a result, the size of the counter weight 50 can be increased, and hence, the inertial force generated in the counter weight 50 in the event of a side collision of the vehicle can be increased.

Features of the above-described door outer handle will be described below. As shown in FIGS. 4, 8, and 9, because the outer circumferential surface 52 of the counter weight 50, which is located farthest from the contact point 40*a*, is formed in an arc shape centered at the contact point 40*a*, the outer circumferential surface 52 conforms to the path of a circle centered at the contact point 40*a*, the path being followed when the door outer handle 40 is rotated in the door's outside-inside direction about the contact point 40*a* and attached to the outer panel 60. As a result, the volume of the counter weight 50 on the outer circumferential surface 52 side can be increased, thereby reducing the size thereof in the vehicle's width direction, and it is possible to ensure a sufficient size of the counter weight 50.

Furthermore, because the outer circumferential surface 52 of the counter weight 50 is formed in an arc shape centered at the contact point 40*a*, the counter weight 50 can be inserted into the second attachment hole 63 so as to conform to the path of a circle centered at the contact point 40*a*, the path being followed when the door outer handle 40 is attached to the outer panel. As a result, the door outer handle 50 can be easily attached to the outer panel 60 from the outside.

As shown in FIGS. 1, 4, 8, and 9, because both the inner circumferential surface 53 and the outer circumferential surface 52 of the counter weight 50 have shapes conforming to the paths of circles centered at the contact point 40*a*, the center of gravity of the counter weight 50 can be placed closer to the contact point 40*a* than to the center of the second attachment hole 63. More specifically, because the counter weight 50 has such a shape that a portion of the outer circumferential surface 52 is removed, and the removed portion is added to the inner circumferential surface 53, the center of gravity of the counter weight 50 can be placed even closer to the contact point 40*a*, at a position near the center of gravity of the door outer handle 40. This increases the inertial force generated in the counter weight 50 in the event of a side collision of the vehicle 10, enabling the counter weight 50 to effectively function.

As shown in FIGS. 4 to 7, because the entire snap portion 54 is located between the inner circumferential surface 53 and the outer circumferential surface 52, the door outer handle 40 can be attached to the outer panel 60 with the snap portion 54 being attached to the counter weight 50. Thus, the productivity improves.

Although the door outer handle is provided on the right rear door of the vehicle in the embodiment, the configuration is not limited thereto. The door outer handle may be provided on the right front door or on the left front and rear doors of the vehicle.

The technique disclosed herein is suitable for the door outer handle provided on a car door. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

We claim:

1. A door outer handle attached to an outer panel of a vehicle door from the outside, the outer panel having a first attachment hole and a second attachment hole arranged along a longitudinal direction of a vehicle, wherein the door outer handle has an elongated shape extending along the longitudinal direction of the vehicle, wherein the door outer handle includes, at one longitudinal end, a contact point that comes into contact with an edge of the first attachment hole when the door outer handle is attached to the outer panel, the door outer handle being rotatable in a door's outside-inside direction about the contact point, wherein the door outer handle includes, at the other longitudinal end, a counter weight inserted inside the door through the second attachment hole, and wherein the counter weight includes an outer circumferential surface located farthest from the contact point, the outer circumferential surface being a substantially arc shape of a first arc having a center at the contact point in a state in which the door outer handle is attached to the outer panel, wherein the counter weight includes an inner circumferential surface located closer to the contact point than the outer circumferential surface, the inner circumferential surface being a substantially arc shape of a second arc having a center at the contact point in the state in which the door outer handle is attached to the outer panel, and the counter weight entirely resides between the first arc and the second arc, wherein the door outer handle includes a rod to operate opening or closing of the door, wherein the counter weight includes a snap portion to elastically attach the rod to the counter weight, and the counter weight switches from a door closing position to a door opening position to operate the rod when the door outer handle is pulled outward, wherein the snap portion is entirely located between the inner circumferential surface and the outer circumferential surface, and wherein the snap portion is disposed to overlap with the counter weight in a plan view, the door outer handle includes a handle body extending in the longitudinal direction of the vehicle, and an elastic body biasing the handle body inward in a vehicle width direction, in a state in which the door outer handle is pulled outward, the counter weight is in the door opening position such that a top end of the counter weight is positioned below a top end of the handle body and a lowest end of the counter weight is positioned above a lowest end of the handle body and such that the door outer handle is attached to the second attachment hole by inserting and moving the counter weight along a linear trajectory without fine tuning of the position of the counter weight in the radial direction about the contact point and vertical direction with respect to the second attachment hole during assembly of the door outer handle to the outer panel.

2. The door outer handle according to claim 1, wherein the outer circumferential surface is a rear side surface of the counter weight extending along a door thickness direction.

3. The door outer handle according to claim 1, wherein the inner circumferential surface is a front side surface of the counter weight extending along a door thickness direction.

4. The door outer handle according to claim 1, wherein the inner circumferential surface is a protruded part of a front side surface of the counter weight, the front side surface extending along a door thickness direction, the protruded part protruding toward the front of the vehicle.

5. The door outer handle according to claim 1, wherein the door outer handle includes, at the one longitudinal end, a hinge portion rotatably supporting the door outer handle, and wherein the contact point is a part of the hinge portion.

6. The door outer handle according to claim 1, wherein the first arc and the second arc respectively pass inside the second attachment hole in a width direction of the second attachment hole.

7. The door outer handle according to claim 1, wherein the counter weight includes a cut-out portion, and the snap portion is entirely located in the cut-out portion.

8. The door outer handle according to claim 1, wherein the rod extends downwardly from the counter weight to project beyond the lowest end of the counter weight.

* * * * *